US011672721B2

(12) United States Patent
Sankai

(10) Patent No.: US 11,672,721 B2
(45) Date of Patent: Jun. 13, 2023

(54) MOTION ASSISTING APPARATUS

(71) Applicants: CYBERDYNE Inc., Tsukuba (JP); University of Tsukuba, Tsukuba (JP)

(72) Inventor: Yoshiyuki Sankai, Ibaraki (JP)

(73) Assignees: CYBERDYNE, INC., Tsukuba (JP); University of Tsukuba, Tsukuba (JP)

( * ) Notice: Subject to any disclaimer, the term of this patent is extended or adjusted under 35 U.S.C. 154(b) by 775 days.

(21) Appl. No.: 16/336,824

(22) PCT Filed: Mar. 21, 2017

(86) PCT No.: PCT/JP2017/011285
§ 371 (c)(1),
(2) Date: Mar. 26, 2019

(87) PCT Pub. No.: WO2018/055812
PCT Pub. Date: Mar. 29, 2018

(65) Prior Publication Data

US 2020/0345574 A1 Nov. 5, 2020

(30) Foreign Application Priority Data

Sep. 26, 2016 (JP) ..... JP2016-187596

(51) Int. Cl.
*A61H 1/02* (2006.01)

(52) U.S. Cl.
CPC ... *A61H 1/0288* (2013.01); *A61H 2201/1215* (2013.01); *A61H 2201/149* (2013.01);
(Continued)

(58) Field of Classification Search
CPC ..... A61H 1/0288; A61H 2201/1215; A61H 2201/149; A61H 2201/1638;
(Continued)

(56) References Cited

U.S. PATENT DOCUMENTS 5,178,137 A * 1/1993 Goor ..... A61F 5/0111 601/40
5,697,892 A * 12/1997 Torgerson ..... A61H 1/0288 601/40

(Continued)

FOREIGN PATENT DOCUMENTS

CN 104107133 A 10/2014
EP 2070492 A1 6/2009

(Continued)

OTHER PUBLICATIONS

Extended European Search Report for related EP App No. 17852593.7 dated Apr. 22, 2020, 9 pgs.

(Continued)

*Primary Examiner* — Justine R Yu
*Assistant Examiner* — Benjamin M. Kusiak
(74) *Attorney, Agent, or Firm* — Procopio, Cory, Hargreaves & Savitch LLP

(57) ABSTRACT

A motion assisting apparatus includes a multijoint structure having links in series rotatably connected in a relative manner, the links being integrally deformed in a bendable manner, a linear member inserted through each of the links, wherein one end is fixed to the link in front and another end is elongated via the link in rear, a sliding/holding part which fixes an elongated portion of the linear member, and slidably guides the rear link in a connecting direction between each of the links, a drive unit which drives the rear link to slide toward the sliding/holding part and causes the multijoint structure, through which the linear member has been inserted, to engage in an extending or flexing motion, and a control unit which drive-controls the drive unit so that a sliding direction, a sliding speed and a sliding position of the rear link will become an intended state.

12 Claims, 8 Drawing Sheets

(52) U.S. Cl.
CPC ..... *A61H 2201/165* (2013.01); *A61H 2201/1638* (2013.01); *A61H 2201/1659* (2013.01)

(58) Field of Classification Search
CPC ..... A61H 2201/165; A61H 2201/1659; A61H 1/0285; A61H 2201/123; A61H 2201/1635; A61H 2205/065; A61H 2205/067; A61H 1/02; A61H 2001/0207; A61H 2201/0107; A61H 2201/0157; A61H 2201/0176; A61H 2201/018; A61H 2201/0192; A61H 2201/1207; A61H 2201/5007; A61H 2230/085; A61H 2230/605; A61F 5/013; A61F 5/10; A61F 2005/0165
USPC ..... 601/5
See application file for complete search history.

(56) References Cited

U.S. PATENT DOCUMENTS

| | | | | |
|---|---|---|---|---|
| 10,449,677 | B1 * | 10/2019 | Al Najjar | B25J 15/0009 |
| 10,682,250 | B1 * | 6/2020 | Al Najjar | B25J 9/104 |
| 2010/0249676 | A1 * | 9/2010 | Kawakami | A61F 5/013 601/40 |
| 2011/0118635 | A1 | 5/2011 | Yamamoto | |
| 2012/0029399 | A1 * | 2/2012 | Sankai | A61B 5/6806 601/40 |
| 2015/0342818 | A1 * | 12/2015 | Ikebe | A61H 1/0288 601/40 |
| 2015/0374575 | A1 * | 12/2015 | Kamper | A61H 1/0288 601/40 |
| 2016/0325437 | A1 * | 11/2016 | Laville | B25J 15/0009 |
| 2017/0266075 | A1 * | 9/2017 | Becchi | A63B 23/16 |

FOREIGN PATENT DOCUMENTS

| | | | |
|---|---|---|---|
| FR | 2822404 | A1 | 9/2002 |
| JP | 2007-313093 | A | 12/2007 |
| JP | 2010-063723 | A | 3/2010 |
| JP | 4716456 | B2 | 4/2011 |
| JP | 2011-255467 | A | 12/2011 |
| JP | 5472680 | B2 | 2/2014 |
| WO | 2004021936 | A1 | 3/2004 |
| WO | 2014/173175 | A1 | 10/2014 |
| WO | 2016088071 | A1 | 6/2016 |

OTHER PUBLICATIONS

International Search Report for related International Application No. PCT/JP2017/011285, dated Jun. 20, 2017 English translation provided; 10 pages.

* cited by examiner (A)

(B)

MOTION ASSISTING APPARATUS

CROSS-REFERENCE TO RELATED APPLICATIONS

This application is a U.S. National Stage entry of PCT Application No: PCT/JP2017/011285 filed Mar. 21, 2017, which claims priority to Japanese Patent Application No. 2016-187596, filed Sep. 26, 2016, the contents of which are incorporated herein by reference.

TECHNICAL FIELD

The present invention relates to a motion assisting apparatus, and in particular can be suitably applied to a motion assisting apparatus for assisting the daily performance of persons suffering from finger paralysis among persons suffering from upper limb dysfunction.

BACKGROUND ART

In Japan, there are currently approximately 440,000 persons suffering from upper limb dysfunction. Among symptoms of upper limb dysfunction, finger paralysis causes daily movements, such as holding daily necessities, to be difficult, and will considerably deteriorate the QOL (Quality of Life) of persons suffering from finger paralysis. Thus, finger motion assisting devices for assisting daily movements, such as holding daily necessities, by assisting the finger motion of persons suffering from finger paralysis have been proposed and developed.

Conventionally, a device for assisting the flexing motion and extending motion of fingers by mounting an actuator on the lateral surface of each finger joint has been proposed (refer to PTL 1), but the mounting part needs to be manufactured to match the length between the finger joints of individuals, and it is difficult to swiftly apply this device to persons suffering from finger paralysis.

Thus, recently, the present inventors proposed a wearable motion assisting apparatus which moves a linear member, which is sewn to the insertion part of each finger of a glove, in an extending direction or a bending direction according to the wearer's intention (refer to PTL 2).

CITATION LIST

Patent Literature

[PTL 1] Specification of Japanese Patent No. 4716456
[PTL 2] Specification of Japanese Patent No. 5472680

SUMMARY OF THE INVENTION

Problems to be Solved by the Invention

While the wearable motion assisting apparatus disclosed in PTL 2 is advantageous with respect to the point that it adopts a mechanism capable of absorbing the individual difference in the length between the finger joints of the wearers, from a structural perspective, it is only able to exhibit power of a level of being able to extend or bend the fingers according to the movement of each finger joint by pulling or loosening the wire drawn out from the back of the hand.

Among the manual procedures of human beings, it is said that the holding of objects is an important function. In order to stably hold daily necessities, the respective fingers need to come into contact with the surface of the target object to be held, and come to fit with the surface of the target object to be held.

Thus, upon assisting the holding motion of a person's fingers, it is desirable to convey power along the finger surface at all times, irrespective of the posture of the respective fingers, and assist the flexing motion independently for each finger.

The heaviest object used upon classifying the holding mode of daily necessities was a plastic bucket containing 4 kg worth of items. When holding a plastic bucket, generally speaking the index finger, middle finger, ring finger, and little finger are all used in a hook shape, and it is considered that the fingertip force of the index finger, middle finger, ring finger, and little finger needs to be 9.8 N or more.

Nevertheless, with the wearable motion assisting apparatus disclosed in PTL 2, it is extremely difficult to apply fingertip force of 9.8 N or more to the fingertips in a state of relaxation.

The present invention was devised in view of the foregoing points, and an object of this invention is to propose a motion assisting apparatus capable of assisting a person's holding motion, at a sufficiently practical level, with a simple configuration.

Means to Solve the Problems

In order to achieve the foregoing object, the present invention provides a motion assisting apparatus, comprising: a multijoint structure in which links in series are rotatably connected in a relative manner, and all of the links can be integrally deformed in a bendable manner; a linear member which is inserted through each of the links in the multijoint structure, wherein one end is fixed to the link in front and another end is elongated via the link in rear; a sliding/holding part which fixes an elongated portion of the linear member, and slidably guides the rear link in a connecting direction between each of the links; a drive unit which drives the rear link to slide toward the sliding/holding part and causes the multijoint structure, through which the linear member has been inserted, to engage in an extending motion or a flexing motion; and a control unit which drive-controls the drive unit so that a sliding direction, a sliding speed and a sliding position of the rear link will become an intended state.

According to this motion assisting apparatus, when sliding the rear link toward the sliding/holding part in a direction which compresses the space between the respective links, the linear member is extended so as to pull the front link and cause the multijoint structure to engage in a bending motion on the one hand, and, when sliding the rear link toward the sliding/holding part in a direction which decompresses the space between the respective links, the linear member is loosened so as to cause the multijoint structure to engage in an extending motion on the other hand. In particular, during the bending motion of the multijoint structure, because the space between the respective links will be compressed and become a firm state due to the pressing force of the rear link, even when weight of several kg is applied on the multijoint structure, such weight can be sufficiently held.

Moreover, in the present invention, the drive unit includes an actuator in which a pulley having a predetermined diameter is engaged with an output axis; and a power line which is stretched between the pulley and a fixed axis of the sliding/holding part, and fixed and connected to the pulley, and rotative force of the output axis of the actuator is transmitted as linear motion to the rear link which is fixed to a part of the power line via the pulley.

When the drive unit as a linear motion actuator which slides the rear link is configured, for example, from an air cylinder or a hydraulic cylinder, or a ball screw, it would result in the enlargement or increased weight of the mounting portion. Thus, by configuring the drive unit as disclosed in the present invention, the bi-directional winding of the power line can be instantaneously performed only with the rotational drive of the output axis, and the drive unit and the control unit can be installed at a position separate from the multijoint structure via the power line.

Furthermore, in the present invention, with the multijoint structure, the respective links are connected in a separable manner, and a length from the front link to the rear link can be adjusted by inserting or removing a desired number of the links. Consequently, when the present invention is worn on the wearer's fingers as a body-worn motion assisting apparatus, the length of the body-worn motion assisting apparatus can be easily adjusted according to the length of the wearer's finger joints.

Furthermore, in the present invention, the multijoint structure includes a locking mechanism which locks a relative angle of rotation of each of the links at a predetermined angle or more, and the multijoint structure is restricted from bending more than necessary based on the locking mechanism. Consequently, when the present invention is worn on the wearer's fingers as a body-worn motion assisting apparatus, because the locking mechanism plays the role of a so-called hard limiter, safety can be ensured by preventing the wearer's fingers from being extended excessively.

Furthermore, in the present invention, the control unit respectively sets an upper limit and a lower limit to a level of pulling or loosening of the multijoint structure by the drive unit, and restricts the links of the multijoint structure from sliding only within a range of the upper limit and the lower limit. Consequently, when the present invention is worn on the wearer's fingers as a body-worn motion assisting apparatus, because the control content plays the role of a so-called soft limiter, safety can be ensured by preventing the wearer's fingers from being extended or flexed excessively.

Furthermore, in the present invention, the motion assisting apparatus further comprises: a signal detection unit which is disposed on a surface of a wearer's body, and detects a myopotential signal or a biosignal for moving fingers, and the control unit causes the drive unit to generate power according to the wearer's intention based on a myopotential signal or a biosignal output by the signal detection unit. Consequently, when the present invention is worn on the wearer's fingers as a body-worn motion assisting apparatus, voluntary motion assistance according to the wearer's intention can be offered.

Furthermore, in the present invention, the motion assisting apparatus further comprises: a motion detection unit which is disposed on a surface of a wearer's body and detects a micromotion of fingers, and the control unit causes the drive unit to generate power in an extending direction or a flexing direction according to the wearer's intention based on a detection result of the motion detection unit. Consequently, when the present invention is worn on the wearer's fingers as a body-worn motion assisting apparatus, voluntary motion assistance according to the wearer's intention can be offered.

Furthermore, in the present invention, the sliding/holding part is fixed to a back of the wearer's hand, and the multijoint structure is mounted on the wearer's fingers so that the front link engages with the wearer's fingertips and each of the links runs along a surface of a back of the wearer's fingers, and the control unit controls pulling or loosening of the power line based on the drive unit and causes the multijoint structure to engage in an extending motion or a flexing motion according to movement of the wearer's fingers.

Consequently, power can be transmitted along the surface of the wearer's fingers, and the flexing motion and the extending motion of fingers can be assisted with the same multijoint structure.

Furthermore, in the present invention, the motion assisting apparatus further comprises: a glove having flexibility so that it can be worn on the wearer's fingers, and the sliding/holding part is fixed to a portion corresponding to a back of hand of the glove, and the front link of the multijoint structure is fixed to a portion corresponding to fingertips of the glove. Consequently, the motion assisting apparatus can be easily worn by the wearer while increasing the adhesion of the multijoint structure and the wearer's fingers.

Furthermore, in the present invention, the drive unit and the control unit are disposed at a position separate from a back of the wearer's hand where the sliding/holding part and the multijoint structure are disposed. Consequently, the part to be mounted on the wearer's hand can be downsized, and, because the drive unit and the control unit are provided separately via the power line, increase in weight can be avoided by that much.

Advantageous Effects of the Invention

According to the present invention, it is possible to realize a motion assisting apparatus capable of applying holding force of a multijoint structure during a flexing motion, at a sufficiently practical level, and assisting a person's flexing motion and extending motion, at a sufficiently practical level, with a simple configuration.

DESCRIPTION OF EMBODIMENTS

An embodiment of the present invention is now explained in detail with reference to the appended drawings.

(1) Configuration of Motion Assisting Apparatus in this Embodiment

Figure 1:
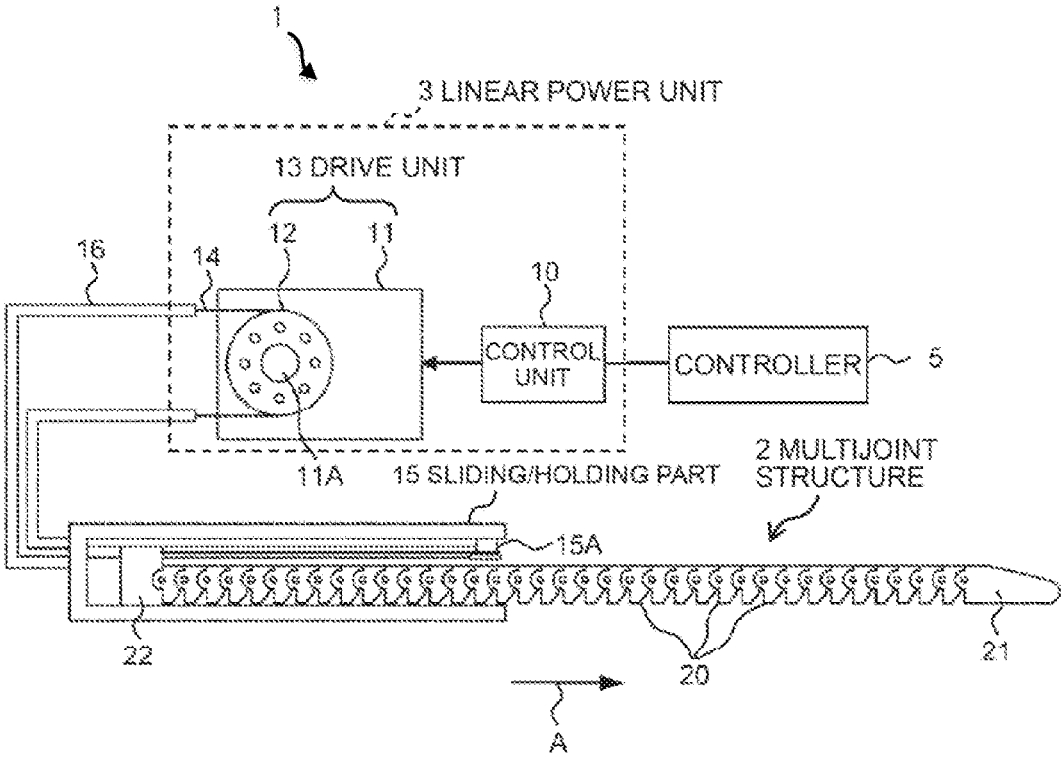
FIG. 1 is a schematic diagram showing the overall configuration of the motion assisting apparatus according to this embodiment.

FIG. 1 shows a motion assisting apparatus 1 in this embodiment configured from a multijoint structure 2 which is deformable in a bendable manner, a linear power unit 3 for slidably driving the multijoint structure 2 in an intended direction, and a controller 5 which enables a wearer to input operations.

(1-1) Configuration of Linear Power Unit 3

The linear power unit 3 includes a control unit 10 configured from a computer which governs the control of the overall apparatus, a drive unit 13 which rotatably drives a pulley 12 engaged with an output axis 11A of a servo motor 11, and a sliding/holding part 15 which slidably guides the overall multijoint structure 2 in a direction shown with arrow A or an opposite direction thereof while holding a rear end of the multijoint structure 2 via a power line 14 stretched across the pulley 12.

The drive unit 13 includes a servo motor 11 in which a pulley 12 having a diameter of approximately 30 mm is engaged with an output axis 11A, and, by rotating the output axis 11A in the rotating direction and at the rotating speed according to the control of the control unit 10, bidirectionally winds the power line 14 stretched across the pulley 12. The power line 14 is configured from a metal wire having high pulling strength and is fixed and connected to the pulley 12, and rotatably stretched between the pulley 12 and a fixed axis 15A of the sliding/holding part 15.

The drive unit 13 transmits, as linear motion, the rotative force of the output axis 11A of the servo motor 11 to the rear end (rear link described later) of the multijoint structure 2 which is fixed to a part of the power line 14 via the pulley 12. The position of the rear end of the multijoint structure 2 which is subject to linear motion is estimated by the control unit 10 based on the current angle of rotation of the pulley 12.

By configuring the servo motor 11 as a linear motion actuator, the bi-directional winding of the power line 14 can be instantaneously performed only with the rotational drive of the output axis 11A, and the drive unit 13 and the control unit 10 can be installed at a position separate from the multijoint structure 2 via the power line 14. Note that the power line 14 between the drive unit 13 and the sliding/holding part 15 is protected by being covered with an outer wire 16.

The controller 5 is equipped with a power source (not shown) such as a battery, and power is thereby supplied to the servo motor 11. This power source may also be provided separately from the controller 5.

As described above, with the motion assisting apparatus 1, the control unit 10 in the linear power unit 3 can slidably move (linear motion) the multijoint structure 2 in the arbitrary direction and at the arbitrary length and speed by outputting the designated operating command to the drive unit 13 and thereby driving the angle of rotation of the output axis 11A of the servo motor 11 at an arbitrary angle of rotation, rotation amount and rotating speed.

This operating command is planned in advance according to the target of applying the motion assisting apparatus 1, and, for example, when the motion assisting apparatus 1 is worn on a wearer's fingers, the drive adjustment state of the servo motor 11 is planned so as to perform the extending motion and the flexing motion according to the holding motion that is unique to the wearer. Moreover, the wearer may use the controller 5 to send an arbitrary operating command to the control unit 10.

(1-2) Configuration of Multijoint Structure 2

Figure 2B:
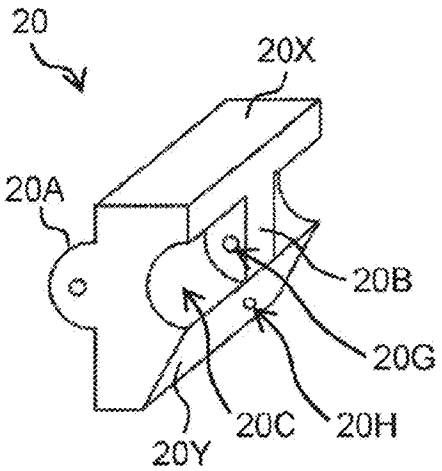
FIGS. 2A-2D are perspective views showing the configurations of each link configuring the multijoint structure according to this embodiment.

The multijoint structure 2 is configured from a structure in which links in series are rotatably connected in a relative manner. As shown in FIG. 2(A) and FIG. 2(B), a link 20 has a width of 10 mm, a connecting direction length of 9 mm, and a flexing direction height of 8 mm, is configured from resin or metal having relatively high mechanical strength, and either end thereof has a connecting structure for connecting to other links 20. Of the connecting structure, one end has a pair of semi-cylindrical convex parts 20A, the other end has a pair of concave parts 20C with a center supporting part 20B therebetween, and adjustment holes 20G for respectively inserting pins 20P are formed penetratively in a direction that is perpendicular to the connecting direction.

As a result of fitting the convex parts 20A and the concave parts 20C of the links 20 and inserting the pins 20P into the adjustment holes 20G thereof, the links 20 can be rotatably connected to each other. The pins 20P can be removably inserted into the adjustment holes 20G, and the links 20 can thereby be freely connected according to the intended length.

Moreover, an upper side part 20X which represents a flexing direction height of the link 20, and, while the surface thereof is formed in a flat rectangular parallelepiped shape on the one hand, a lower side part 20Y thereof is formed in a wedge shape which tapers toward the tip on the other hand.

Figure 2D:
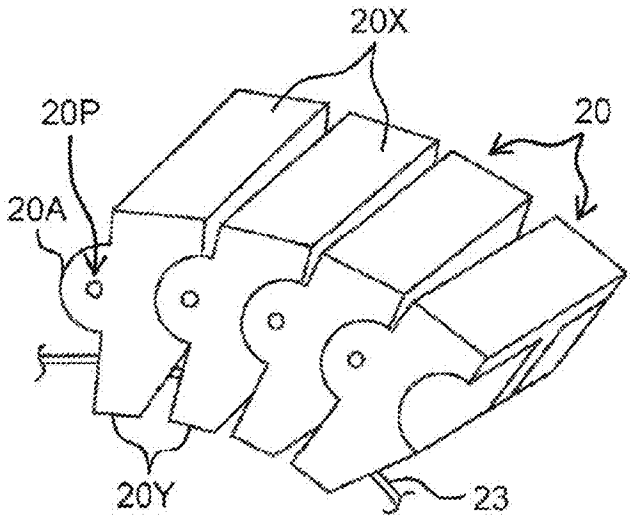
Figure 2A:
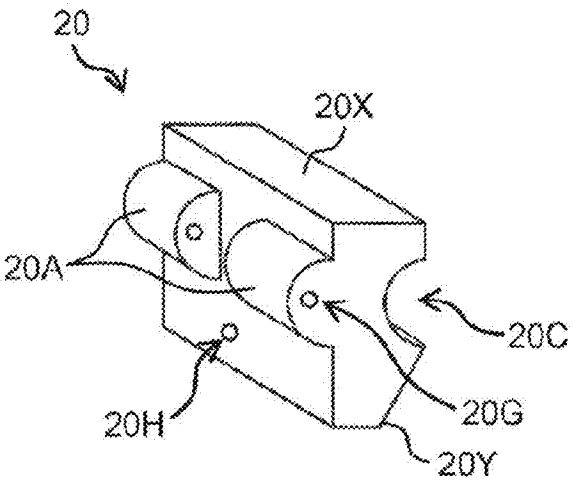
Figure 2C:
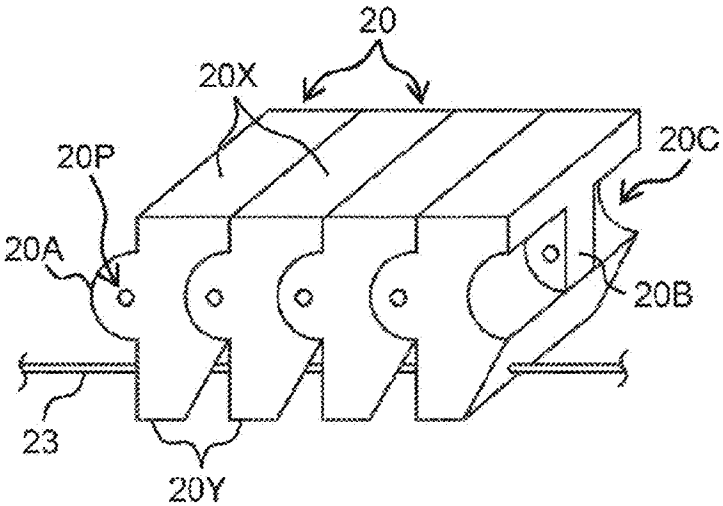

Consequently, when fitting and connecting the links 20 as shown in FIG. 2(C), as a result of the parts of the rectangular parallelepiped shape of adjacent upper side parts 20X coming into contact with each other, the parts of such rectangular parallelepiped shape play the role of a locking mechanism (so-called hard limiter), and the adjacent links 20 are locked at a predetermined angle or more. Thus, it is possible to prevent the multijoint structure 2 from bending in the extending direction more than necessary.

Meanwhile, when fitting and connecting the links 20 as shown in FIG. 2(D), the multijoint structure 2 can be bent in the flexing direction until the wedge-shaped portions of adjacent lower side parts 20Y come into contact with each other.

Note that the center portion of the lower side part 20Y of the link 20 is provided with an insertion hole 20H for inserting a linear member 23 described later, and, during the flexing motion of the multijoint structure 2, the adjacent links 20 can firmly maintain the contact state of the wedge-shaped portions of the lower side part 20Y.

A front link 21 in the multijoint structure 2 has a shape that is similar to a person's fingertip, and, even when the multijoint structure 2 is worn on the wearer's fingertips, the multijoint structure 2 can press the fingernail surface and assist the wearer's holding motion at a sufficiently practical level.

Meanwhile, a rear link 22 in the multijoint structure 2 is an operating point to which the driving force by the linear power unit 3 is directly applied, and the overall multijoint structure 2 is pushed or pulled back by being slid in the connecting direction of the links 20 or the opposite direction thereof.

Note that, in the multijoint structure 2, a linear member 23 is inserted through each of the links 20, wherein one end of the linear member 23 is fixed to the front link 21 and the other end is elongated via the rear link 22 and fixed to a predetermined site 15B of the sliding/holding part 15 described later (site facing the stopping position Q of FIG. 3(A) described later).

As the linear member 23, used may be, for example, a member configured from metal, resin such as plastic, rubber or ceramic, and a wire, rope, belt-like rope, or chain can be applied so as long as it has pulling strength and tensile elongation (stretching properties) of several kg to several ten kg.

Figure 3A:
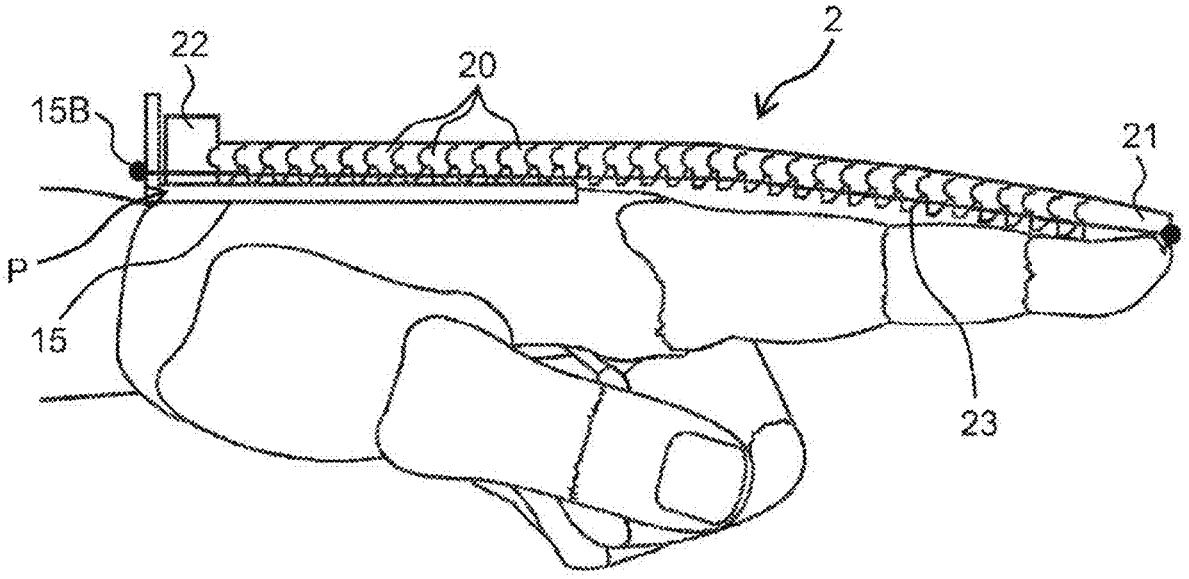
FIGS. 3A-3B are conceptual diagrams explaining the operating states of the multijoint structure according to this embodiment.

In the linear power unit 3, as shown in FIG. 3(A), when the rear link 22 of the multijoint structure 2 is actually slid from a starting position P of the link holding part 15 in the link connecting direction, the linear member 23 inserted through each of the links 20 pulls the front link 21 and bends the multijoint structure 2 while pushing the multijoint structure 2. The force for bending the multijoint structure 2 is transmitted to the target object (wearer's hand in the drawings), and bends the target object (wearer's finger in the drawings). Note that, when the target object is the wearer's finger, the extension of the finger surface that occurs pursuant to the bending of that finger is absorbed by the multijoint structure 2.

Figure 3B:
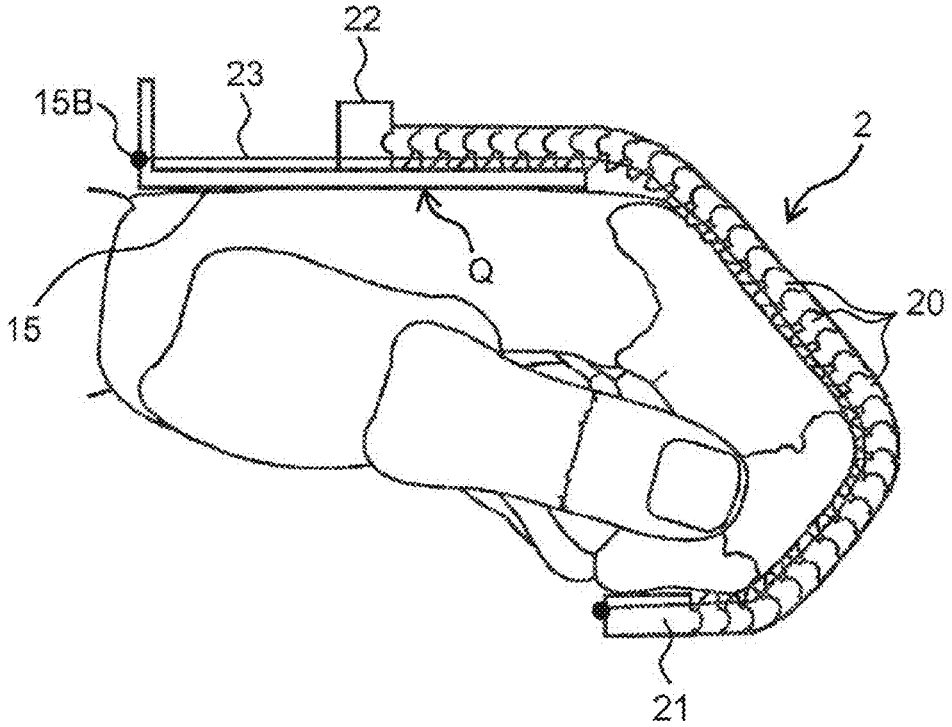

Meanwhile, in the linear power unit 3, as shown in FIG. 3(B), when the rear link 22 of the multijoint structure 2 is slid from the stopping position Q to the starting position P, the force of the linear member 23, which is inserted through each of the links 20, of pulling the front link 21 is weakened, and the force generated in the direction of bending the target object will also become weakened. Subsequently, by pulling the front link 21 of the multijoint structure 2, the multijoint structure 2 is extended. Note that, when the target object is the wearer's finger, the fingertip held by the front link 21 is pulled by the multijoint structure 2, and the finger is extended.

(2) Configuration of Body-Worn Motion Assisting Apparatus 1

A case of using the foregoing motion assisting apparatus 1 for assisting the holding motion of the wearer's fingers is now explained. Among the components of the linear power unit 3, the sliding/holding part 15 is fixed to the back of the wearer's hand and the front link 21 of the multijoint structure 2 is engaged with the fingertip, and each link 20 is mounted on the wearer's finger along the surface of the back of the wearer's finger.

As a result of the control unit 10 of the linear power unit 3 controlling the pulling or loosening of the power line 14 by the drive unit 13, as shown in FIG. 3(A) and FIG. 3(B) described above, the control unit 10 causes the multijoint structure 2 to engage in an extending motion or a flexing motion according to the movement of the wearer's fingers. Consequently, power can be transmitted along the surface of the wearer's fingers, and the flexing motion and the extending motion of fingers can be assisted with the same multijoint structure 2.

As a method of engaging the wearer's fingertip with the front link 21, it would be effective to use the multijoint structure 2 and the sliding/holding part 15 by bonding them to a glove 30, so that they can be easily worn, while improving the adhesion of the multijoint structure 2 and the wearer's fingers.

The glove 30 is formed from a synthetic leather material, and silicon is applied on the surface for slip resistance. The sliding/holding part 15 is bonded or sewn to the portion corresponding to the back of the wearer's hand of the glove 30, and the front link 21 of the multijoint structure 2 is fixed to the portion corresponding to the wearer's fingertips of the glove 30. It is thereby possible to prevent the sliding/holding part 15 from falling off the back of the wearer's hand, and the wearer can easily wear the multijoint structure 2 on one's fingers while improving the adhesion between the multijoint structure 2 and the wearer's fingers.

Furthermore, a guide band 31 made from Velcro (registered trademark), which enables the insertion of the multijoint structure 2 in a free manner, is wound together with the multijoint structure 2 at the site corresponding to the space between the Proximal Interphalangeal (PIP) joint and the MP joint of the wearer's fingers of the glove 30, whereby the unity of the multijoint structure 2 and the wearer's fingers can be improved.

Moreover, Velcro (registered trademark) 32 is wound around the site corresponding to the wearer's wrist of the glove 30, whereby the sliding/holding part 15 is prevented from shifting in the fingertip direction (link connecting direction) upon causing the wearer's fingers to engage in an extending motion.

Note that, in the motion assisting apparatus 1, among the components of the linear power unit 3, by installing the drive unit 13 and the control unit 10 at a position separate from the back of the wearer's hand, the part to be mounted on the wearer's hand can be downsized, and, because the drive unit 13 and the control unit 10 are provided separately via the power line 14, increase in weight can be avoided by that much.

For example, with the motion assisting apparatus 1 in this embodiment, because the weight of the bonding part which combines the multijoint structure 2 and the sliding/holding part 15 is 170 g, and the weight, when including the servo motor 11 as the drive unit 13, is 850 g, considerable weight-saving is enabled.

Figure 5A:
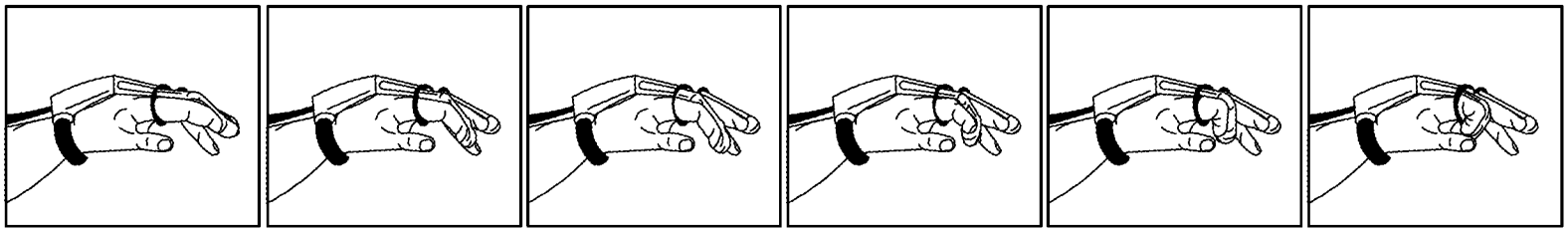
FIGS. 5A-5B are continuous perspective views explaining the operating states of the glove-type motion assisting apparatus according to this embodiment.
Figure 5B:
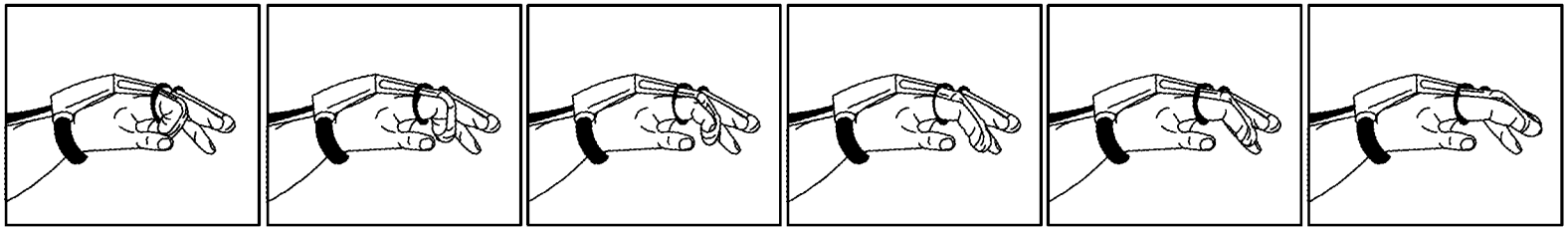
Figure 6A:
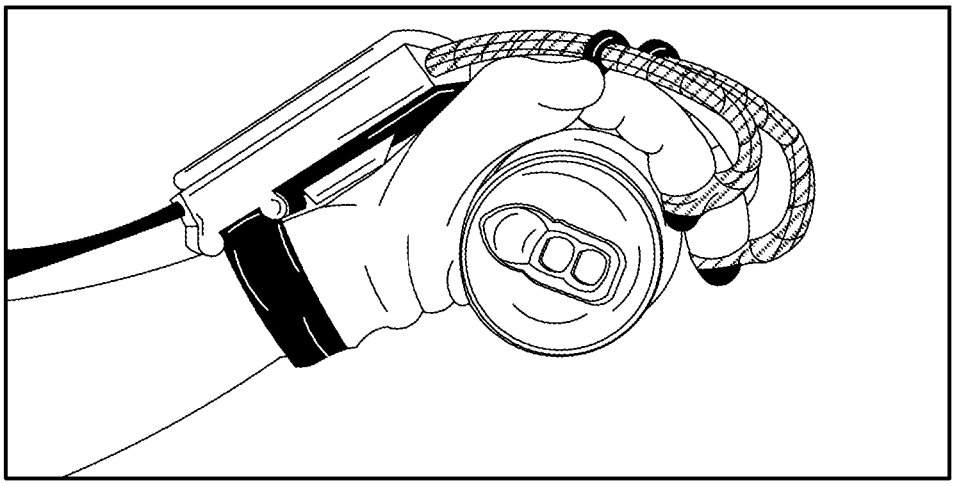
FIGS. 6A-6D are perspective view showing the experimental results of the glove-type motion assisting apparatus according to this embodiment.
Figure 6B:
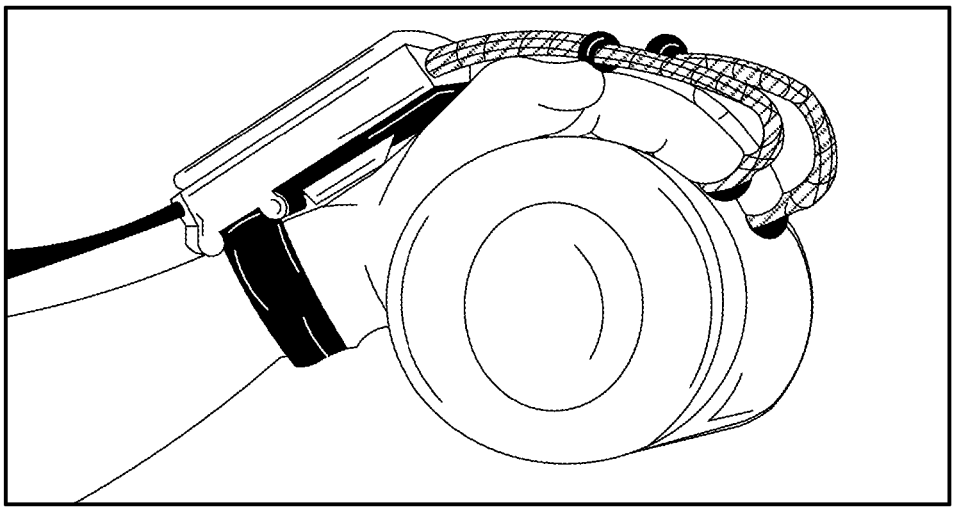
Figure 6D:
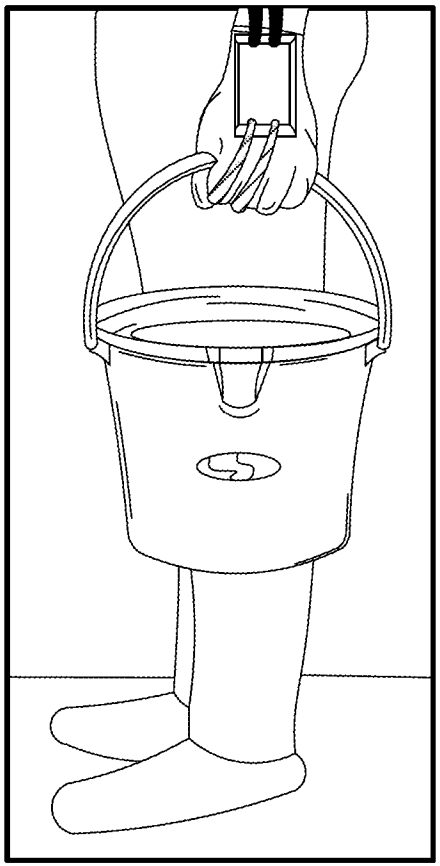
Figure 6C:
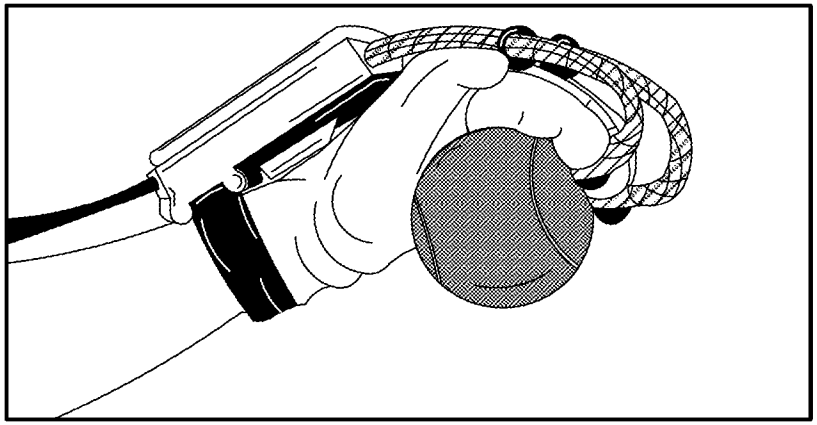

When the wearer actually wears the glove 30 equipped with the multijoint structure 2 and the sliding/holding part 15 on one's fingers and performs a flexing motion and an extending motion, as shown in FIG. 5(A) and FIG. 5(B), it was confirmed that the wearer could perform the flexing motion and the extending motion without any problem.

Furthermore, an experimental case of the wearer performing a holding motion using the motion assisting apparatus 1 is now explained. In the glove 30-type motion assisting apparatus 1 described above, the multijoint structure 2 is mounted on the wearer's index finger (forefinger) and middle finger so that the wearer can stably hold the target object.

The target objects used in this experiment were a 350 ml aluminum can, a cylinder having a diameter of 100 mm, a tennis ball, and a plastic bucket containing 2 kg worth of objects. The 350 ml aluminum can, cylinder having a diameter of 100 mm, and tennis ball were placed on a desk, and the plastic bucket containing 2 kg worth of objects was placed on the floor. The wearer touched the surface of the target object using one's index finger and middle finger. Instructions were given so that the wearer will raise the target object in a state of simulating a relaxed state of the index finger and middle finger.

In the linear power unit 3, as a result of the control unit 10 controlling the drive unit 13 according to the instructions from the wearer and pushing the multijoint structure 2 toward the fingertip direction (connecting direction of the links 20), the wearer's index finger and middle finger in a state of relaxation will hold the target object. According to this experiment, as shown in FIG. 6(A) to FIG. 6(D), the wearer was able to raise all target objects until they were lifted from the desk or the floor.

Based on this experiment, the force applied to the wearer's fingertips engaged to the front link 21 of the multijoint structure 2 was 12.4±1.6 N as the average value of 5 persons. Consequently, it was confirmed that fingertip force of 9.8 N or more could be applied to the fingers simulating a state of relaxation while wearing the multijoint structure 2.

Figure 7:
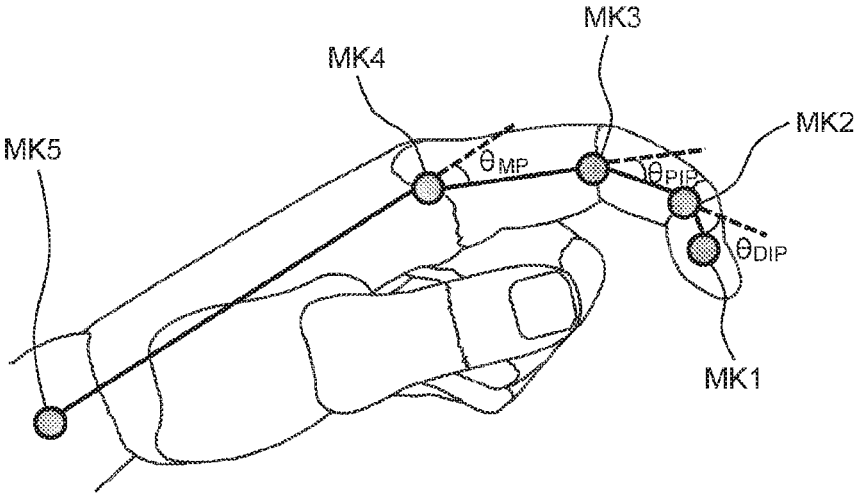
FIG. 7A shows markers respectively affixed to wearer's fingertips and finger joints.
FIG. 7B is a diagram showing the experimental results of the range of motion of finger joints upon wearing and not wearing the multijoint structure.
Figure 7:
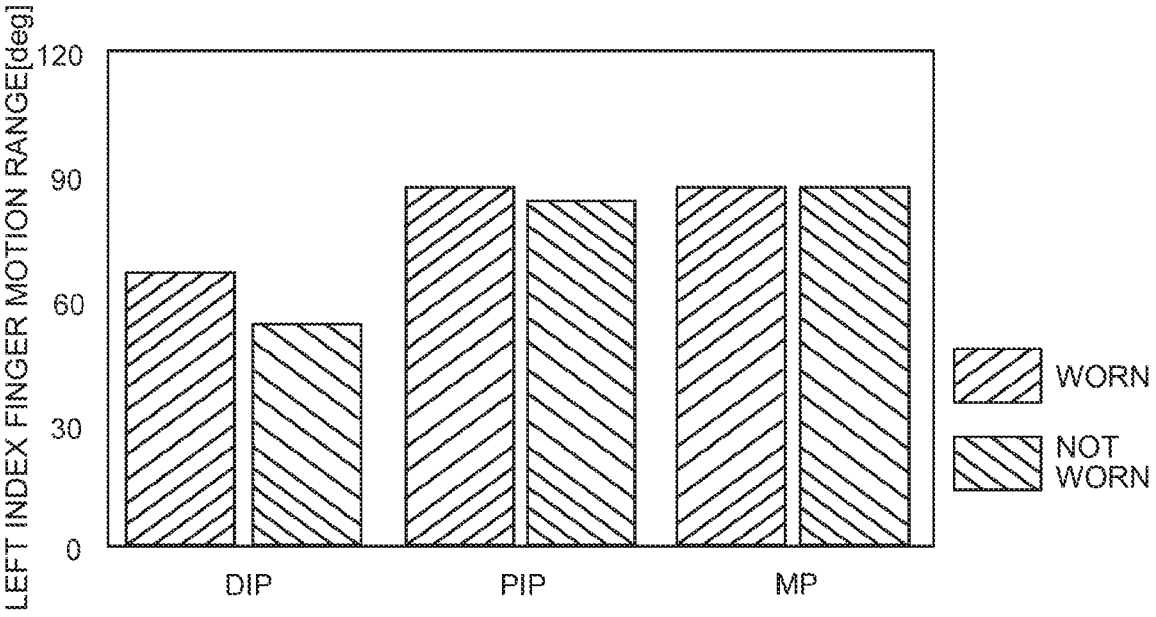

Furthermore, as shown in FIG. 7(A), markers were respectively affixed to the wearer's fingertips and finger joints (DIP joint, PIP joint, MP joint) and the processus styloideus radii at points Mk1, Mk2, Mk3, Mk4, and MK5, and experiments for measuring the respective angles $\theta_{DIP}$, $\theta_{PIP}$, and $\theta_{MP}$ of the wearer's finger joints (DIP joint, PIP joint, MP joint) when the wearer wore, and did not wear, the multijoint structure 2 were conducted.

According to these experimental results, as shown in FIG. 7(B), the range of motion of the finger joints of the wearer wearing the multijoint structure 2 was distal interphalangeal (DIP) joint 66.7 deg, PIP joint 86.7 deg, and metacarpophalangeal (MP) joint 86.2 deg, the range of motion of the finger joints of the wearer not wearing the multijoint structure 2 was DIP joint 53.2 deg, PIP joint 84.5 deg, and MP joint 86.0 deg, and it was confirmed that the multijoint structure 2 of the present invention does not restrict the range of the wearer's finger motion.

(3) Other Embodiments

While this embodiment explained a case of applying the motion assisting apparatus of the present invention to the body-worn motion assisting apparatus 1 for assisting the daily performance of persons primarily suffering from finger paralysis among persons suffering from upper limb dysfunction, the present invention is not limited thereto, and can also be applied as a robot hand capable of performing a holding motion even when not worn by the wearer.

Moreover, while this embodiment explained a case where the control unit 10 of the linear power unit 3 controls the drive unit 13 based on an externally designated operating command, the present invention is not limited thereto, and the drive unit 13 may also be drive-controlled by using a control algorithm of offering voluntary motion assistance by reading the wearer's moving intention from biological information such as biopotential signals or micromotion of fingers.

Figure 4:
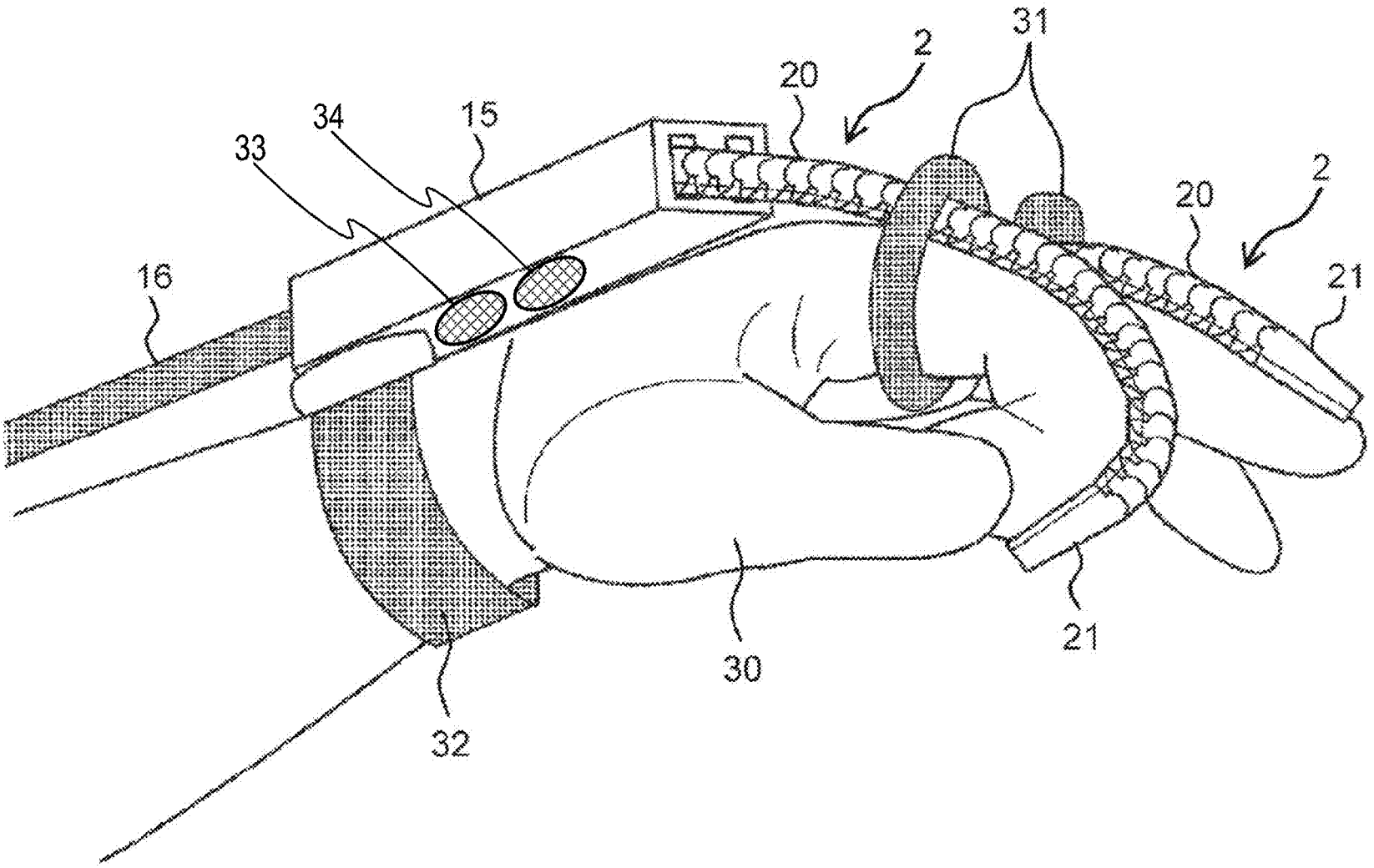
FIG. 4 is a partial external view showing the configuration of the glove-type motion assisting apparatus according to this embodiment.

For example, the body-worn motion assisting apparatus 1 may further comprise a signal detection unit 33 in FIG. 4, which is disposed on a surface of a wearer's body, and detects a myopotential signal or a biosignal for moving fingers, and the control unit 10 may cause the drive unit 13 to generate power according to the wearer's intention based on a myopotential signal or a biosignal output by the signal detection unit 33. Consequently, when the present invention is worn on the wearer's fingers as a body-worn motion assisting apparatus, voluntary motion assistance according to the wearer's intention can be offered.

Furthermore, the body-worn motion assisting apparatus 1 may further comprise a motion detection unit 34 in FIG. 4, which is disposed on a surface of a wearer's body and detects a micromotion of fingers, and the control unit 10 may cause the drive unit 13 to generate power in an extending direction or a flexing direction according to the wearer's intention based on a detection result of the motion detection unit 34. Consequently, when the present invention is worn on the wearer's fingers as a body-worn motion assisting apparatus, voluntary motion assistance according to the wearer's intention can be offered.

Furthermore, while this embodiment explained a case of providing a locking mechanism (hard limiter) which locks the multijoint structure 2 at a predetermined angle or more at the upper side part 20X, which is adjacent to the structure of each link 20, so that the multijoint structure 2 is restricted from bending more than necessary, the present invention is not limited thereto, and similar effects can be obtained even by providing a so-called soft limiter in which the angle of the servo motor 11 required upon completely bending the wearer's fingers is set as a maximum value, and the angle of the servo motor 11 required upon completely extending the wearer's fingers is set as a minimum value.

REFERENCE SIGNS LIST

1 . . . motion assisting apparatus, 2 . . . multijoint structure, 3 . . . linear power unit, 5 . . . controller, 10 . . . control unit, 11 . . . servo motor, 11A . . . output axis, 12 . . . pulley, 13 . . . drive unit, 14 . . . power line, 15 . . . sliding/holding part, 16 . . . outer wire, 20 . . . link, 20A . . . convex part, 20B . . . supporting part, 20C . . . concave part, 20G . . . adjustment hole, 20H . . . insertion hole, 20P . . . pin, 20X . . . upper side part, 20Y . . . lower side part, 21 . . . front link, 22 . . . rear link, 23 . . . linear member, 30 . . . glove, 31 . . . guide band, 32 . . . Velcro (registered trademark).

The invention claimed is:

1. A motion assisting apparatus, comprising:

a multijoint structure in which links are rotatably connected to each other in series, and the multijoint structure is configured to be integrally deformed in a bendable manner;

a linear member which is inserted through each of the links in the multijoint structure, wherein one end of the linear member is fixed to a front link in front of the links and another end of the linear member is elongated via a rear link in rear of the links;

a sliding/holding part which is attached to an elongated portion of the linear member, and slidably guides the rear link in a longitudinal direction of the multijoint structure between each of the links, the sliding/holding part including a housing covering the rear link;

an actuator which drives the rear link to slide with respect to the sliding/holding part and causes the multijoint structure, through which the linear member has been inserted, to engage in an extending motion or a flexing motion; and a control unit which drive-controls the actuator so that a sliding direction, a sliding speed and a sliding position of the rear link will become an intended state.

2. The motion assisting apparatus according to claim 1, wherein the actuator includes:

an actuator in which a pulley having a predetermined diameter is engaged with an output axis; and a power line which is stretched between the pulley and a fixed axis of the sliding/holding part, and the power line is fixed and connected to the pulley, wherein rotative force of the output axis of the actuator is transmitted as linear motion to the rear link, which is attached to a part of the power line via the pulley.

3. The motion assisting apparatus according to claim 1, wherein, with the multijoint structure, the respective links are connected in a separable manner, and a length from the front link to the rear link is adjustable by inserting or removing a desired number of the links.

4. The motion assisting apparatus according to claim 1, wherein the multijoint structure includes a hard limiter which locks a relative angle of rotation of each of the links at a predetermined angle or less, and the multijoint structure is restricted from bending more than a predetermined amount based on the lock.

5. The motion assisting apparatus according to claim 1, wherein the control unit respectively sets an upper limit and a lower limit to a level of pulling or loosening of the multijoint structure by the actuator, and restricts the links of the multijoint structure for sliding only within a range of the upper limit and the lower limit.

6. The motion assisting apparatus according to claim 1, further comprising:

a signal detector which is configured to be disposed on a surface of a wearer's body, and detects a myopotential signal or a biosignal for moving fingers, wherein the control unit causes the actuator to generate power according to a wearer's intention based on the myopotential signal or the biosignal output by the signal detector.

7. The motion assisting apparatus according to claim 1, further comprising:

a motion detector which is configured to be disposed on a surface of a wearer's body and detects a micromotion of fingers, wherein the control unit causes the actuator to generate power in an extending direction or a flexing direction according to a wearer's intention based on a detection result of the motion detector.

8. The motion assisting apparatus according to claim 6, wherein the sliding/holding part is configured to be fixed to a back of a wearer's hand, and the multijoint structure is mounted on the wearer's fingers so that the front link engages with wearer's fingertips and each of the links runs along a surface of a back of the wearer's fingers, and wherein the control unit controls pulling or loosening of a power line using the actuator, and causes the multijoint structure to engage in an extending motion or a flexing motion with a movement of the wearer's fingers.

9. The motion assisting apparatus according to claim 8, further comprising:

a glove having flexibility so that the glove is adapted to be worn on the wearer's fingers, wherein the sliding/holding part is fixed to a portion corresponding to a back of the glove, and the front link of the multijoint structure is fixed to a portion corresponding to fingertips of the glove.

10. The motion assisting apparatus according to claim 8, wherein the actuator and the control unit are disposed at a position separate from the back of the wearer's hand where the sliding/holding part and the multijoint structure are disposed.

11. A motion assisting apparatus, comprising:

a multijoint structure in which links are rotatably connected to each other in series, and the multijoint structure is configured to be integrally deformed in a bendable manner;

a linear member which is inserted through each of the links in the multijoint structure, wherein one end of the linear member is fixed to a front link in front of the links and another end of the linear member is elongated via a rear link in rear of the links;

a sliding/holding part which is attached to an elongated portion of the linear member, and slidably guides the rear link in a longitudinal direction of the multijoint structure between each of the links, the sliding/holding part including a housing covering the rear link;

an actuator which drives the rear link to slide with respect to the sliding/holding part and causes the multijoint structure, through which the linear member has been inserted, to engage in an extending motion or a flexing motion;

a control unit which drive-controls the actuator so that a sliding direction, a sliding speed and a sliding position of the rear link will become an intended state;

a signal detector which is configured to be disposed on a surface of a wearer's body, and detects a myopotential signal or a biosignal for moving fingers, wherein the control unit causes the actuator to generate power according to a wearer's intention based on the myopotential signal or a biosignal output by the signal detector; and a motion detector which is configured to be disposed on the surface of the wearer's body and detects a micromotion of fingers, wherein the control unit causes the actuator to generate power in an extending direction or a flexing direction according to the wearer's intention based on a detection result of the motion detector, wherein the sliding/holding part is configured to be fixed to a back of a wearer's hand, and the multijoint structure is mounted on the wearer's fingers so that the front link engages with wearer's fingertips and each of the links runs along a surface of a back of the wearer's fingers, and wherein the control unit controls pulling or loosening of a power line using the actuator, and causes the multijoint structure to engage in an extending motion or a flexing motion with a movement of the wearer's fingers.

12. The motion assisting apparatus according to claim 1, wherein the control unit causes the actuator to generate power in an extending direction or a flexing direction according to a wearer's intention based on:

a myopotential signal or a biosignal for moving fingers detected on a surface of a wearer's body; and a micromotion of fingers detected on the surface of the wearer's body.

* * * * *